US009822784B2

(12) United States Patent
Aiba et al.

(10) Patent No.: US 9,822,784 B2
(45) Date of Patent: Nov. 21, 2017

(54) VARIABLE GEOMETRY EXHAUST TURBOCHARGER

(71) Applicant: MITSUBISHI HEAVY INDUSTRIES, LTD., Tokyo (JP)

(72) Inventors: Mitsuru Aiba, Tokyo (JP); Takashi Arai, Tokyo (JP); Takamitsu Himeno, Tokyo (JP); Yukihide Nagayo, Tokyo (JP); Noriyuki Hayashi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 362 days.

(21) Appl. No.: 14/418,368

(22) PCT Filed: Aug. 7, 2013

(86) PCT No.: PCT/JP2013/071320
§ 371 (c)(1),
(2) Date: Jan. 29, 2015

(87) PCT Pub. No.: WO2014/024905
PCT Pub. Date: Feb. 13, 2014

(65) Prior Publication Data

US 2015/0211538 A1 Jul. 30, 2015

(30) Foreign Application Priority Data

Aug. 8, 2012 (JP) ..... 2012-175801

(51) Int. Cl.
*F04D 27/00* (2006.01)
*F01D 17/16* (2006.01)
(Continued)

(52) U.S. Cl.
CPC ..... *F04D 27/002* (2013.01); *F01D 17/165* (2013.01); *F02M 26/00* (2016.02);
(Continued)

(58) Field of Classification Search
CPC ..... F04D 27/02; F04D 29/023; F04D 19/02; F02M 26/00; F01D 17/165;
(Continued)

(56) References Cited

U.S. PATENT DOCUMENTS

2009/0269235 A1 10/2009 Fukae et al.
2010/0124489 A1 5/2010 Suzuki et al.
(Continued)

FOREIGN PATENT DOCUMENTS

CN 101978137 A 2/2011
CN 102325974 A 1/2012
(Continued)

OTHER PUBLICATIONS

Office Action effective Jul. 25, 2016 issued in the corresponding Chinese Application No. 201380039297.6 with an English Translation.
(Continued)

*Primary Examiner* — Marina Tietjen
(74) *Attorney, Agent, or Firm* — Birch, Stewart, Kolasch & Birch, LLP

(57) ABSTRACT

An object is to provide a variable-geometry exhaust turbocharger including a variable nozzle mechanism in which nozzle supports may not deform under a high-temperature condition. A variable-geometry exhaust turbocharger (1) includes: a nozzle mount (2); a nozzle support (6) having a first end coupled to a first face (2*a*) of the nozzle mount; a nozzle plate (4) coupled to the second end of the nozzle support and supported to be separated from the first face (2*aa*) of the nozzle mount, the nozzle plate having a first face (4*a*) coupled to the nozzle support and a second face (4*b*) which is opposite to the first face and which faces an exhaust gas channel (20) through which exhaust gas flows: a plurality of nozzle vanes (8) rotatably supported between the
(Continued)

nozzle mount and the nozzle plate; and a variable nozzle mechanism (10) configured to change vane angles of the nozzle vanes to control a flow of the exhaust gas flowing between the nozzle mount and the nozzle plate. The nozzle plate is formed of a material having a smaller linear expansion coefficient than that of a material forming the nozzle mount.

5 Claims, 6 Drawing Sheets

(51) Int. Cl.
*F02M 26/00* (2016.01)
*F04D 19/02* (2006.01)
*F04D 29/02* (2006.01)
*F02B 37/24* (2006.01)

(52) U.S. Cl.
CPC ..... *F04D 19/02* (2013.01); *F04D 29/023* (2013.01); *F02B 37/24* (2013.01); *F05D 2220/40* (2013.01); *F05D 2300/17* (2013.01); *F05D 2300/50212* (2013.01)

(58) Field of Classification Search
CPC ..... F05D 2300/17; F05D 2300/50212; F05D 2220/40; F02B 37/24
USPC ..... 415/160, 164, 146
See application file for complete search history.

(56) References Cited

U.S. PATENT DOCUMENTS

| | | | | |
|---|---|---|---|---|
| 2010/0209232 | A1* | 8/2010 | Stein | F02C 6/12 415/148 |
| 2011/0014032 | A1 | 1/2011 | Boening et al. | |
| 2011/0296829 | A1 | 12/2011 | Hayashi et al. | |

FOREIGN PATENT DOCUMENTS

| | | | |
|---|---|---|---|
| EP | 1 099 838 | A1 | 5/2001 |
| EP | 2 143 909 | A2 | 1/2010 |
| JP | 63-57329 | U | 4/1988 |
| JP | 10-103070 | A | 4/1998 |
| JP | 2009-150363 | A | 7/2009 |
| JP | 2009-281295 | A | 12/2009 |
| JP | 2010-19252 | A | 1/2010 |
| JP | 2010-169101 | A | 8/2010 |
| JP | 2010-196657 | A | 9/2010 |
| JP | 2011-515608 | A | 5/2011 |
| JP | 4885118 | B2 | 2/2012 |
| JP | 2012-52520 | A | 3/2012 |

OTHER PUBLICATIONS

Decision to Grant a Patent effective Sep. 29, 2016 issued to the corresponding JP Application No. 2012-175801 with an English Translation.

International Preliminary Report on Patentability and Written Opinion of the International Searching Authority (forms PCT/IB/373, PCT/ISA/237, PCT/IB/326 and PCT/IB/338), dated Feb. 19, 2015, for International Application No. PCT/JP2013/071320, along with a translation of the Written Opinion.

International Search Report and Written Opinion of the International Searching Authority (forms PCT/ISA/210, PCT/ISA/237 and PCT/ISA/220), dated Nov. 5, 2013, for International Application No. PCT/JP2013/071320.

Extended European Search Report dated Sep. 16, 2015 issued to the corresponding EP Application No. 13827476.6.

* cited by examiner

LINEAR EXPANSION COEF α(×10$^{-6}$)

| TEMPERATURE T[°C] | SUS | Ni-BASE ALY A | Ni-BASE ALY B |
|---|---|---|---|
| 1000 | 20.0 | 16.7 | 17.4 |
| 900 | 19.2 | 16.0 | 17.0 |

FIG. 6

| CASE NO. | | WORKING EX.1 | | WORKING EX.2 | | WORKING EX.3 | | REF EX.1 | | REF EX.2 | | REF EX.3 | |
|---|---|---|---|---|---|---|---|---|---|---|---|---|---|
| | TEMP[°C] | MATL | RATE | MATL | RATE | MATL | RATE | MATL | RATE | MATL | RATE | MATL | RATE |
| NOZZLE PLATE 4 | 1000 | ALY A | 1.64% | ALY B | 1.71% | ALY A | 1.64% | SUS | 1.96% | ALY A | 1.64% | ALY B | 1.71% |
| NOZZLE MOUNT 2 | 900 | SUS | 1.69% | SUS | 1.69% | ALY B | 1.50% | SUS | 1.69% | ALY A | 1.41% | ALY B | 1.50% |
| DIFF (A) | | | -0.05% | | 0.02% | | 0.14% | | 0.27% | | 0.23% | | 0.21% |

(REFERENCE TEMP. T0=20°C)

ALY A : Ni-BASE ALLOY A
ALY B : Ni-BASE ALLOY B
MATL : MATERIAL
RATE : EXTENSION RATE
DIFF : EXTENSION RATE DIFFERENCE

FIG. 10

LINEAR EXPANSION COEF $\alpha(\times 10^{-6})$

| TEMP.T[°C] | SUS |
|---|---|
| 850 | 18.9 |
| 760 | 18.2 |

FIG. 11

| TEMP [°C] | MATERIAL | EXTENSION RATE | NOTE |
|---|---|---|---|
| 850 | SUS | 1.57% | NOZZLE PLATE4 |
| 760 | SUS | 1.35% | NOZZLE MOUNT2 |
| EXTENSION RATE DIFF(A) | | 0.22% | |

(REFERENCE TEMPERATURE T0=20°C)

VARIABLE GEOMETRY EXHAUST TURBOCHARGER

TECHNICAL FIELD

The present disclosure relates to a variable-geometry exhaust turbocharger including a variable nozzle mechanism.

BACKGROUND

In an exhaust turbocharger used in a diesel engine of a vehicle, a variable nozzle mechanism is widely used. The variable nozzle mechanism is disposed between an exhaust gas channel of a scroll shape formed in a turbine housing and a turbine rotor rotatably disposed at the center of the turbine housing to control the flow of the exhaust gas acting on the turbine rotor.

The variable nozzle mechanism includes a nozzle mount and a nozzle plate which are supported by nozzle supports and spaced from each other. A plurality of nozzle vanes are supported rotatably between the nozzle mount and the nozzle plate. The angle of the nozzle vanes is varied to control the flow of the exhaust gas flowing between the nozzle mount and the nozzle plate, and thereby the flow of the exhaust gas acting on the turbine rotor is controlled.

For instance, Japanese Patent No. 4885118 filed by the present applicant discloses an example of a variable-geometry exhaust turbocharger including such a variable nozzle mechanism.

CITATION LIST

Patent Literature

Patent Document 1: Japanese Patent No. 4885118

SUMMARY

Technical Problem

The temperature of exhaust gas discharged from a diesel engine may increase as high as approximately 850° C., causing thermal deformation in a nozzle mount and a nozzle plate formed of stainless steel or the like. At this time, the amount of thermal deformation is varied between the nozzle mount and the nozzle plate because the nozzle mount contacts the high-temperature exhaust gas at only one face fixed to a bearing housing or the like while the nozzle plate is exposed to the high-temperature exhaust gas at both faces. As a result, a shear force or a bending moment may be applied to the nozzle supports 6 coupling the nozzle plate 4 and the nozzle mount 2 as illustrated in FIG. 9, thereby deforming the nozzle supports 6.

FIG. 10 is a chart of linear expansion coefficients of stainless steel at temperatures of 850° C. and 760° C. FIG. 11 is a chart of extension rates of stainless steel at temperatures of 850° C. and 760° C., and an extension rate difference between the above temperatures.

An extension rate here means the amount of strain, $\alpha \times \Delta T$, where $\Delta T$ is the amount of temperature change from the reference temperature T0 of a material, and $\alpha$ is the linear expansion coefficient.

When the same kind of stainless steel having the same linear expansion coefficient illustrated in FIG. 10 is used for the nozzle mount 2 and the nozzle plate 4, the nozzle plate has an extension rate of 1.56% at a temperature of 850° C.

while the nozzle mount has an extension rate of 1.34% at a temperature of 760° C. as illustrated in FIG. 11. The extension rate difference between the nozzle plate and the nozzle mount is 0.22%. The reference temperature T0 here is 20° C.

When employing a variable-geometry exhaust turbocharger including a variable nozzle mechanism in a gasoline engine in the future, the temperature of exhaust gas discharged from a gasoline engine is expected to be higher than 850° C., which further increases the above difference (extension rate difference) in the amount of thermal deformation between the nozzle mount and the nozzle plate. This may cause an even larger shear force and bending moment to be applied to the nozzle supports.

At least one embodiment of the present invention was made in view of the above problem of the conventional technique to provide a variable-geometry exhaust turbocharger including a variable nozzle mechanism with a small difference in the amount of thermal deformation between the nozzle mount and the nozzle plate under a high-temperature condition, so that a large shear force or bending moment may not act on the nozzle supports to deform the nozzle supports.

Solution to Problem

To achieve the above object, at least one embodiment of the present invention provides a variable-geometry exhaust turbocharger including: a nozzle mount fixed to a housing; a nozzle support having a first end coupled to a first face of the nozzle mount; a nozzle plate coupled to the second end of the nozzle support and supported to be separated from the first face of the nozzle mount, the nozzle plate having a first face coupled to the nozzle support and a second face which is opposite to the first face and which faces an exhaust gas channel through which exhaust gas flows; a plurality of nozzle vanes rotatably supported between the nozzle mount and the nozzle plate; and a variable nozzle mechanism configured to change vane angles of the nozzle vanes to control a flow of the exhaust gas flowing between the nozzle mount and the nozzle plate. The nozzle plate is formed of a material having a smaller linear expansion coefficient than that of a material forming the nozzle mount.

In the variable-geometry exhaust turbocharger with the above configuration, the nozzle plate, which is exposed to the exhaust gas at both sides so that the temperature rises higher, is formed of a material having a smaller linear expansion coefficient than that of a material forming the nozzle mount. As a result, it is possible to reduce the difference in the amount of thermal deformation between the nozzle mount and the nozzle plate under a high-temperature condition as compared to a conventional variable-geometry exhaust turbocharger in which a nozzle mount and a nozzle plate are formed of the same material.

Further, in the variable-geometry exhaust turbocharger according to one embodiment of the present invention, the nozzle plate is formed of heat-resistant Ni-base alloy, and the nozzle mount is formed of stainless steel.

According to the variable-geometry exhaust turbocharger of the above embodiment, the nozzle plate, which is exposed to the exhaust gas at both sides so that the temperature rises higher, is formed of heat-resistant Ni-base alloy which has a small linear expansion coefficient, while the nozzle mount is formed of stainless steel which is relatively low cost. As a result, it is possible to reduce the difference in the amount of thermal deformation between the nozzle mount and the nozzle plate under a high-temperature condition and to reduce the material cost.

Further, in the variable-geometry exhaust turbocharger according to one embodiment of the present invention, the nozzle plate and the nozzle mount are formed of different kinds of heat-resistant Ni-base alloy having different linear expansion coefficients.

According to the variable-geometry exhaust turbocharger of the above embodiment, the nozzle plate is formed of heat-resistant Ni-base alloy having a relatively small linear expansion coefficient while the nozzle mount is formed of heat-resistant Ni-base alloy having a relatively large linear expansion coefficient. Thus, both of the nozzle plate and the nozzle mount are formed of heat-resistant Ni-base alloy, which makes it possible to reduce the difference in the amount of deformation between the nozzle plate and the nozzle mount, and to achieve a variable nozzle mechanism having high heat resistance.

Further, in the variable-geometry exhaust turbocharger according to one embodiment of the present invention, the materials forming the nozzle plate and the nozzle mount are each selected so that an absolute value of an extension rate difference A defined by the following equation (1) is not greater than 0.20%:

$$A=\alpha 1\times(T1-T0)-\alpha 2(T2-T0) \quad \text{Equation (1),}$$

where: $\alpha 1$ is a linear expansion coefficient of the material forming the nozzle plate; $\alpha 2$ is a linear expansion coefficient of the material forming the nozzle mount; T1 is a temperature of the nozzle plate during operation of an engine; T2 is a temperature of the nozzle mount during operation of the engine; and T0 is a reference temperature.

According to the variable-geometry exhaust turbocharger of the above embodiment, the materials forming the nozzle plate and the nozzle mount are each selected so that the absolute value of an extension rate difference A defined by the equation (1) is not greater than 0.20%. In this way, it is possible to provide a variable-geometry exhaust turbocharger including a variable nozzle mechanism in which the difference in the amount of thermal deformation between the nozzle mount and the nozzle plate under a high-temperature condition is small.

A variable-geometry exhaust turbocharger according to one embodiment of the present invention described above may be suitably used in a gasoline engine in which the temperature of exhaust gas becomes high.

Advantageous Effects

According to at least one embodiment of the present invention, it is possible to provide a variable-geometry exhaust turbocharger including a variable nozzle mechanism in which the difference in the amount of thermal deformation between the nozzle mount and the nozzle plate under a high-temperature condition is small, and therefore a large shear force or bending moment may not be applied to the nozzle supports to deform the nozzle supports.

BRIEF DESCRIPTION OF DRAWINGS

FIG. 6 is a chart of differences (extension ratio differences) in the amount of thermal deformation of a nozzle mount and a nozzle plate in cases where stainless steel and the heat-resistant Ni-base alloy A, B are used in the nozzle mount and the nozzle plate.

FIG. 10 is a chart of linear expansion coefficients of stainless steel at temperatures of 850° C. and 760° C.

FIG. 11 is a chart of extension rates of stainless steel at temperatures of 850° C. and 760° C., and an extension rate difference between the temperatures.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 1:
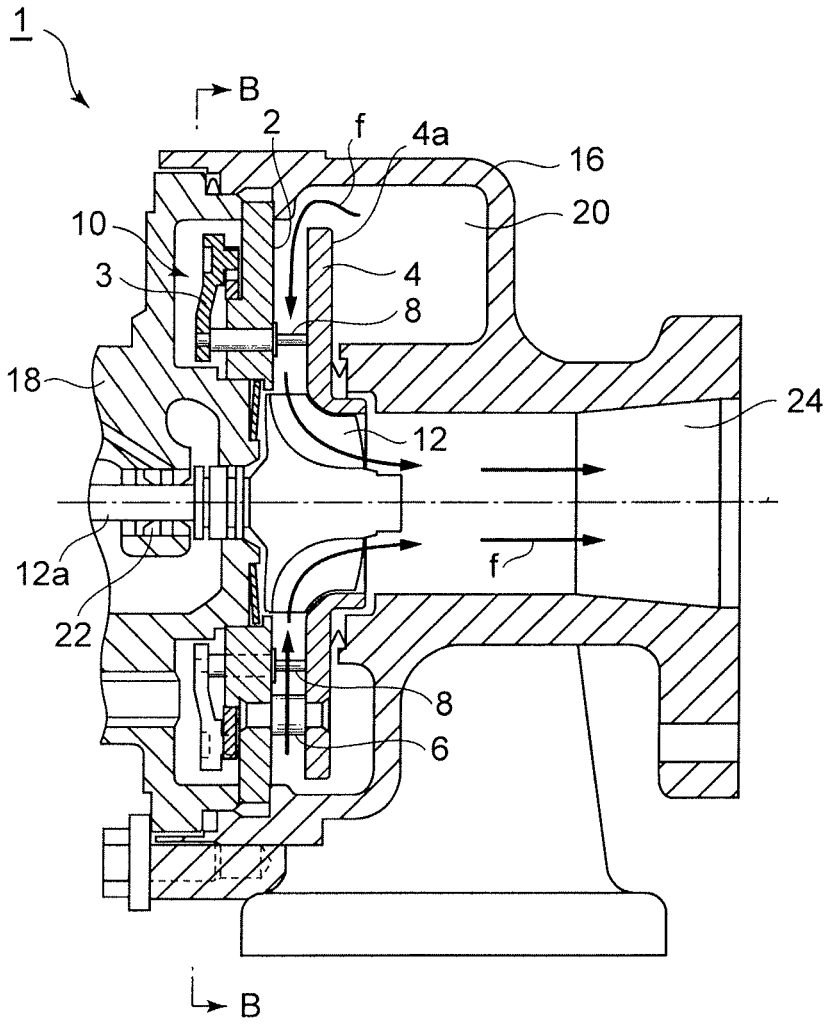
FIG. 1 is a cross-sectional view of a variable-geometry exhaust turbocharger according to one embodiment of the present invention.
Figure 2:
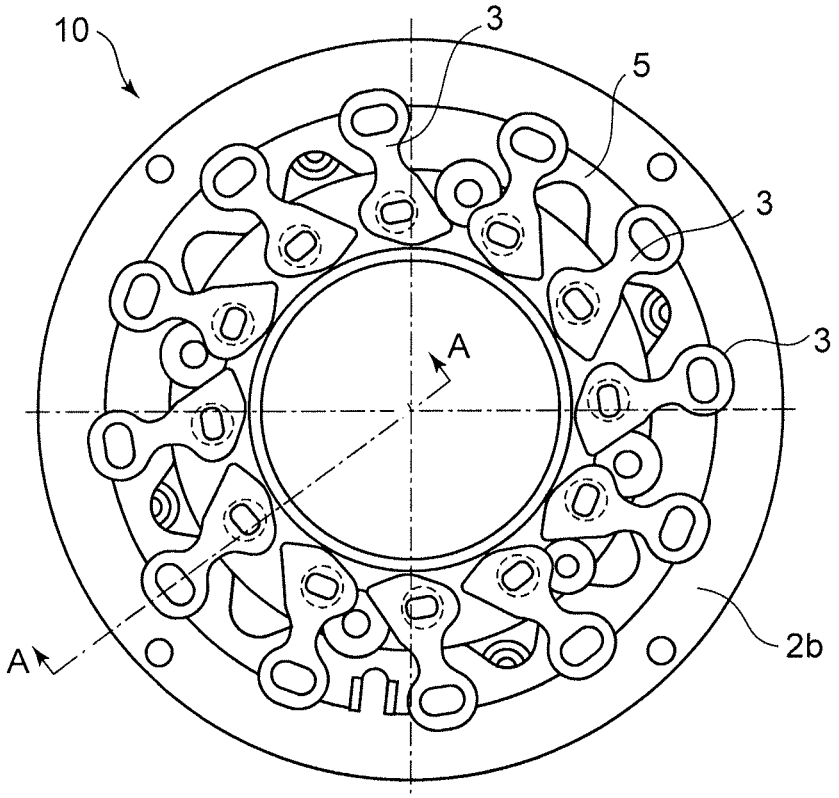
FIG. 2 is a cross-sectional view taken along line B-B of FIG. 1.
Figure 3:
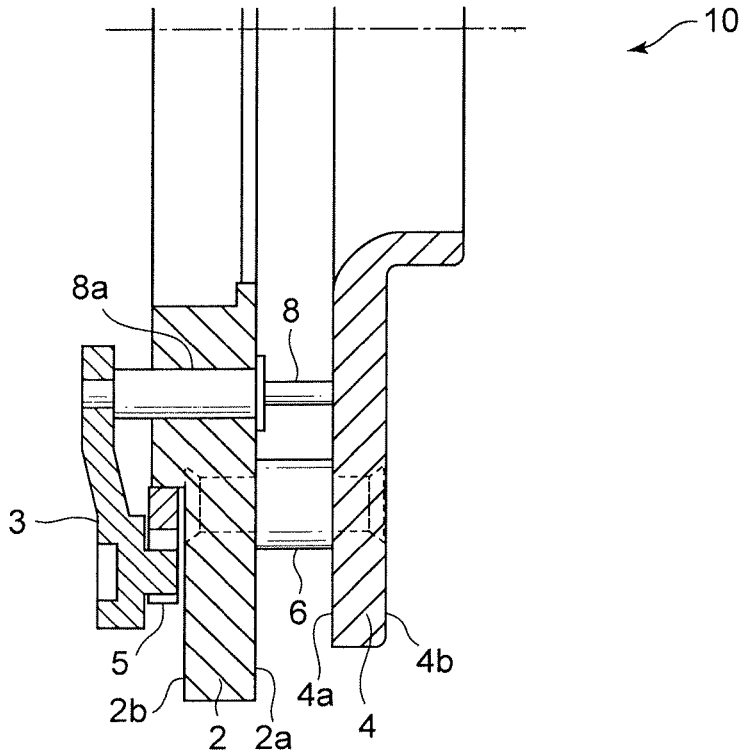
FIG. 3 is a cross-sectional view taken along line A-A of FIG. 2.

FIG. 1 is a cross-sectional view of a variable-geometry exhaust turbocharger according to one embodiment of the present invention. FIG. 2 is a cross-sectional view taken along line B-B of FIG. 1. FIG. 3 is a cross-sectional view taken along line A-A of FIG. 2. First, the basic configuration of a variable nozzle mechanism 10 of a variable-geometry exhaust turbocharger 1 according to one embodiment of the present invention will be described in reference to FIGS. 1 to 3.

As illustrated in FIG. 1, the variable-geometry exhaust turbocharger 1 according to one embodiment of the present invention includes a turbine housing 16 for accommodating a turbine rotor 12, and a bearing housing 18 for accommodating a bearing 22 rotatably supporting a rotational shaft 12*a* of the turbine rotor 12. The turbine housing 16 and the bearing housing 18 are fastened to each other via bolts, for instance. Although not illustrated, a compressor housing for accommodating a compressor rotor coupled to the rotational shaft 12*a* is coupled to the bearing housing 18 at the opposite side of the turbine housing 16 across the bearing housing 18.

On the outer circumferential side of the turbine housing 16, an exhaust gas channel 20 of a scroll shape is formed. The exhaust gas channel 20 communicates with an exhaust-gas manifold (not illustrated), and exhaust gas discharged from an engine flows through the exhaust gas channel 20. Further, a variable nozzle mechanism 10 for controlling the flow of the exhaust gas acting on the turbine rotor 12 is disposed between the exhaust gas channel 20 of a scroll shape and the turbine rotor 12.

As illustrated in FIG. 1, the variable nozzle mechanism 10 is fixed to the bearing housing 18 by the nozzle mount 2 being fastened to the bearing housing 18 by bolts or the like while the variable nozzle mechanism 10 is interposed between the turbine housing 16 and the bearing housing 18. Also, as illustrated in FIG. 3, the variable nozzle mechanism 10 includes a plurality of nozzle supports 6 each of which is a cylindrical member and has the first end coupled to a first face 2*a* of the nozzle mount 2. Moreover, the first face 4*a* of the nozzle plate 4 is coupled to the second end of each nozzle support 6. The plurality of nozzle supports 6 are coupled to the first face 2*a* of the nozzle mount 2 and to the first face 4*a* of the nozzle plate 4 in a circumferential fashion in the planar view. In this way, the nozzle plate 4 is supported at a position spaced away from the first face 2*a* of the nozzle mount 2.

As illustrated in FIGS. 2 and 3, a drive ring 5 formed into a disc-like shape is disposed rotatably on the second face 2*b* of the nozzle mount 2. An end of each lever plate 3 is coupled to the drive ring 5. The opposite end of each lever plate 3 is coupled to a nozzle vane 8 via a nozzle shaft 8*a*, so that each lever plate 3 rotates and the vane angle of each nozzle vane 8 varies in response to rotation of the drive ring 5.

In the variable-geometry exhaust turbocharger 1 including the variable nozzle mechanism 10 with the above configuration, the exhaust gas having flowed through the exhaust gas channel 20 of a scroll shape flows into a gap between the nozzle mount 2 and the nozzle plate 4, and then to the central portion of the turbine housing 16 as the nozzle vanes 8 control the flow direction, as indicated by the arrow "f" of FIG. 1. Then, after acting on the turbine rotor 12, the exhaust gas is discharged to the outside from the exhaust gas outlet 24.

At this point, as illustrated in FIG. 1, the nozzle plate 4 is disposed so that the second face 4*b*, disposed on the opposite side of the first face 4*a* to which the nozzle supports 8 are coupled, faces the exhaust gas channel 20 thorough which the exhaust gas flows. That is, the nozzle plate 4 is exposed to the exhaust gas at both of the first face 4*a* and the second face 4*b*. In contrast, the nozzle mount 2 is in contact with the exhaust gas only at the first face 2*a*, so that the second face 2*b* is oriented to face the bearing housing 18 side and not exposed to the exhaust gas.

As described above, since the nozzle plate 4 is exposed to the exhaust gas at both faces 4*a*, 4*b* while the nozzle mount 2 is in contact with the exhaust gas only at the first face 2*a*, the temperature of the nozzle plate 4 becomes higher than that of the nozzle mount 2 while the engine is in operation. According to the research of the inventors, the temperature of the nozzle plate 4 rises as high as 850° C. in the case of a diesel engine with the exhaust gas temperature of approximately 850° C., while the temperature of the nozzle mount 2 only rises to 760° C. Further, in the case of a gasoline engine with the exhaust gas temperature of approximately 1000° C., the temperature of the nozzle plate 4 rises as high as 1000° C. while the temperature of the nozzle mount 2 only rises to 850° C.

When the nozzle mount 2 and the nozzle plate 4 have different temperatures as described above, a shear force or a bending moment acts on the nozzle support 6 coupling the nozzle mount 2 and the nozzle plate 4 under a high-temperature condition due to the difference in the amount of thermal deformation between the nozzle mount 2 and the nozzle plate 4, thereby possibly deforming the nozzle support 6. Thus, in at least one embodiment of the present invention, the nozzle plate 4 is formed of a material having a linear expansion coefficient smaller than that of a material forming the nozzle mount 2 so as to reduce the difference between the amount of thermal deformation between the nozzle mount 2 and the nozzle plate 4 under a high-temperature condition as will be described below.

In one embodiment of the present invention, as materials of the nozzle mount 2 and the nozzle plate 4, stainless steel and heat-resistance Ni-base alloy including Inconel (Registered trademark) such as Inconel 600, Inconel 625, Inconel 718, and Inconel 750X and Hastelloy (Registered trademark) such as Hastelloy C22, Hastelloy C276, and Hastelloy B may be used suitably.

Figures 4, 5:
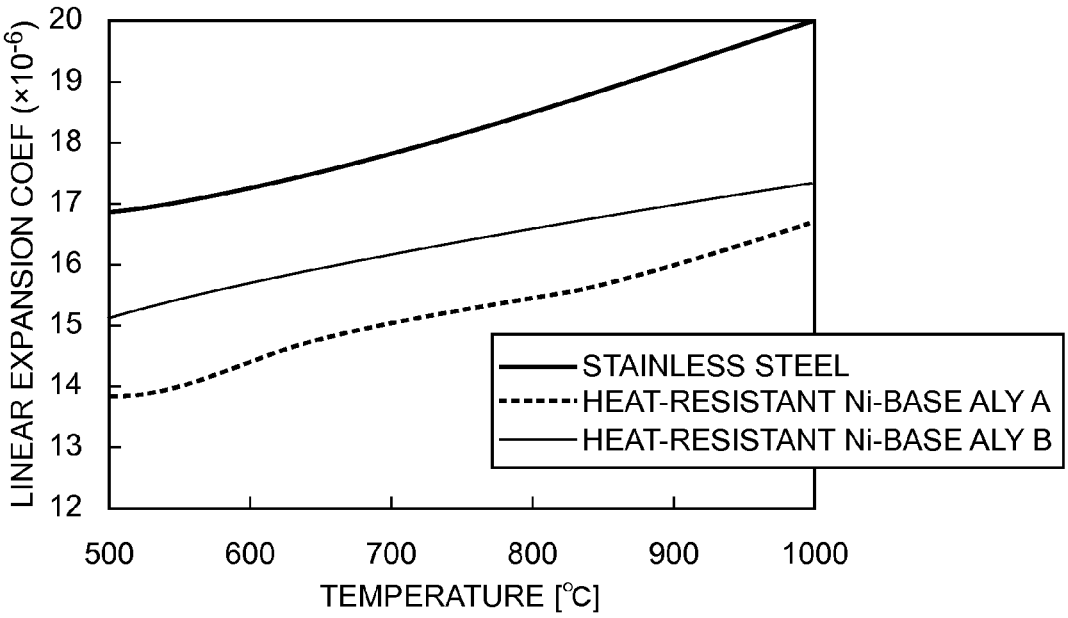
FIG. 4 is a graph of a relationship between linear expansion coefficients and temperature of stainless steel and heat-resistant Ni-base alloy A, B.
FIG. 5 is a chart of linear expansion coefficients of stainless steel and two kinds of heat-resistant Ni-base alloy A, B at temperatures of 900° C. and 1000° C.

FIG. 4 is a graph of a relationship between linear expansion coefficients and temperature of stainless steel and two kinds of heat-resistant Ni-base alloy A, B. FIG. 5 is a chart of linear expansion coefficients of stainless steel and two kinds of heat-resistant Ni-base alloy A, B at temperatures of 900° C. and 1000° C. As illustrated in FIGS. 4 and 5, the two kinds of heat-resistant Ni-base alloy A, B have linear expansion coefficients smaller than that of stainless steel. Also, from among the two kinds of heat-resistant Ni-base alloy A, B, the heat-resistant Ni-base alloy B has a linear expansion coefficient smaller than that of the heat-resistant Ni-base alloy A. In the present description, "a liner expansion coefficient is small" means that a linear expansion coefficient is small when compared between two kinds of materials under a predetermined temperature condition during operation of an engine (for instance, 1000° C. which is an exhaust gas temperature during operation of a gasoline engine).

Figure 7:
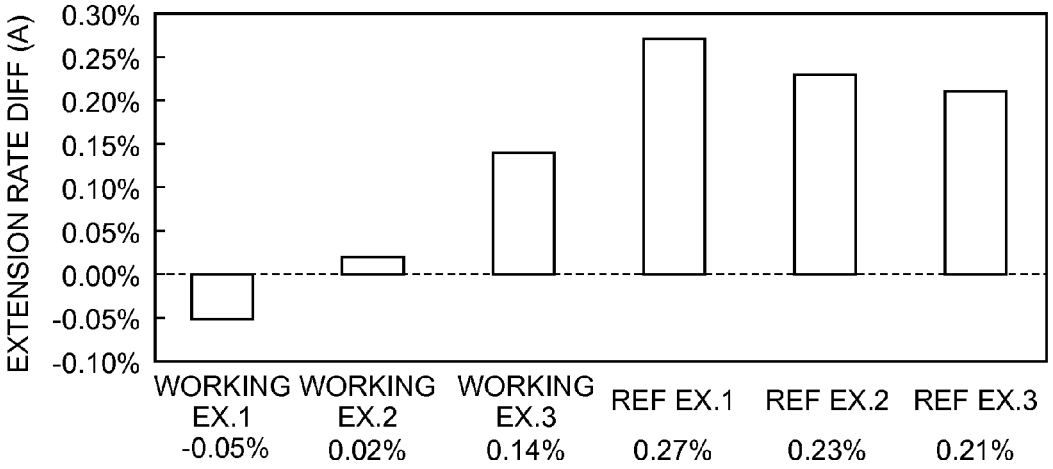
FIG. 7 is a graph of FIG. 6.

FIG. 6 is a chart of differences (extension ratio differences) in the amount of thermal deformation between the nozzle mount 2 and the nozzle plate 4 in cases where stainless steel and two kinds of heat-resistant Ni-base alloy A, B having different linear expansion coefficients are used in the nozzle mount 2 and the nozzle plate 4. FIG. 7 is a graph of FIG. 6.

Here, the extension rate difference (A) is calculated by the following equation (1):

$$A=\alpha 1\times(T1-T0)-\alpha 2(T2-T0) \qquad \text{Equation (1),}$$

where:

$\alpha 1$ is the linear expansion coefficient of a material forming the nozzle plate 4;

$\alpha 2$ is the linear expansion coefficient of a material forming the nozzle mount 2;

T1 is the temperature of the nozzle plate 4 during operation of the engine;

T2 is the temperature of the nozzle mount 2 during operation of the engine; and T0 is the reference temperature (20° C. herein).

Also, in FIGS. 6 and 7, T1 is set to 1000° C. and T2 is set to 900° C. assuming that the variable-geometry exhaust turbocharger 1 is employed in a gasoline engine.

As illustrated in FIGS. 6 and 7, when using heat-resistant Ni-base alloy A for the nozzle plate 4 and stainless steel for the nozzle mount 2, the extension rate difference is minus 0.05% (the first working example). Further, when using heat-resistant Ni-base alloy B for the nozzle plate 4 and stainless steel for the nozzle mount 2, the extension rate difference is 0.02% (the second working example). Still further, when using heat-resistant Ni-base alloy A for the nozzle plate 4 and heat-resistant Ni-base alloy B for the nozzle mount 2, the extension rate difference is 0.14% (the third working example).

On the other hand, when the same material having the same linear expansion coefficient is used for the nozzle mount 2 and the nozzle plate 4, the extension rate difference is 0.21% to 0.27% (the first to third reference examples).

In order to reduce the difference (extension rate difference) in the amount of thermal deformation between the nozzle mount 2 and the nozzle plate 4 under a high-temperature condition to prevent a large shear force and bending moment from being applied to the nozzle supports 6, it is desirable to reduce the difference (extension rate difference) in the amount of thermal deformation between the nozzle mount 2 and the nozzle plate 4 to be small. Preferably, in order to reduce the extension rate difference (A) to a value approximately not greater than the conventional value (see FIG. 11), a material may be selected for each of the nozzle mount 2 and the nozzle plate 4 so that the absolute value of the extension rate difference (A) is not greater than 0.20%.

Further, as illustrated in the first and second working examples, the nozzle plate 4, which is exposed to the exhaust gas at both sides so that the temperature rises higher, is formed of heat-resistant Ni-base alloy having a small linear expansion coefficient, while the nozzle mount 2 is formed of stainless steel which is relatively low cost. In this way, it is possible to reduce the difference (extension rate difference) in the amount of thermal deformation between the nozzle mount 2 and the nozzle plate 4 under a high-temperature condition and also to reduce the material cost.

Figure 8:
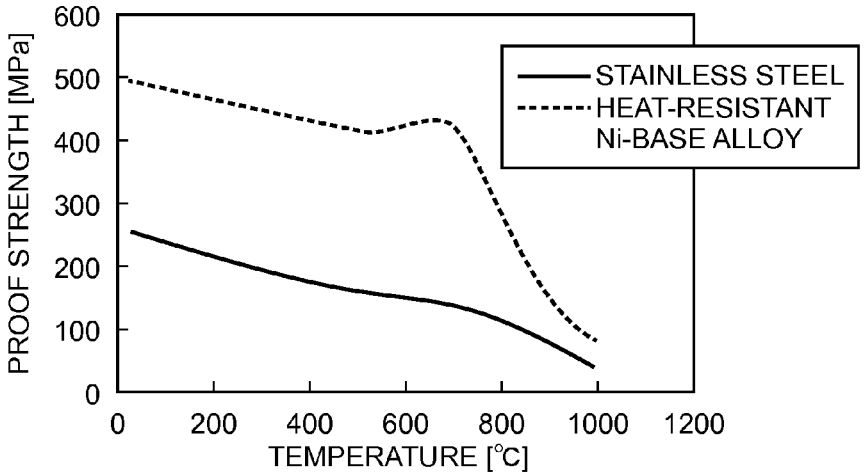
FIG. 8 is a graph of a relationship between proof strength and temperature of stainless steel and heat-resistant Ni-base alloy.
Figure 9:
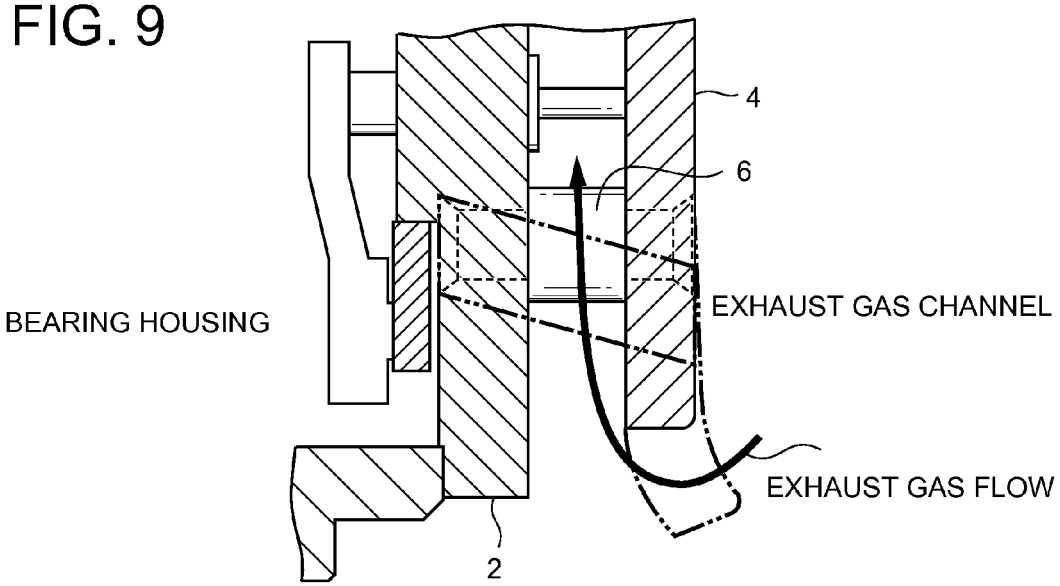
FIG. 9 is a diagram of a state where a nozzle plate and a nozzle mount are deformed to extend, and a shear force or a bending moment is applied to nozzle supports which couple the nozzle plate and the nozzle mount.

Further, as illustrated in FIG. 8, heat-resistant Ni-base alloy has high proof strength under a high-temperature condition as compared to stainless steel. Thus, as illustrated in the third working example, the nozzle plate 4 and the nozzle mount 2 may be both formed of heat-resistant Ni-base alloy, using the heat-resistant Ni-base alloy A having a relatively small linear expansion coefficient for the nozzle plate 4 and the heat-resistant Ni-base alloy B having a relatively large linear expansion coefficient for the nozzle mount 2. In this way, it is possible to reduce the difference (extension rate difference) in the amount of thermal deformation between the nozzle mount 2 and the nozzle plate 4 under a high-temperature condition and to achieve a variable nozzle mechanism 10 with high heat-resistance.

Further, in one embodiment of the present invention, the nozzle supports 6 which are the cylindrical members for coupling the nozzle mount 2 and the nozzle plate 4 may be formed of heat-resistant Ni-base alloy. In this way, it is possible to achieve a variable nozzle mechanism 10 with high proof strength under a high-temperature condition.

Embodiments of the present invention were described in detail above, but the present invention is not limited thereto, and various amendments and modifications may be implemented within a scope that does not depart from the present invention.

INDUSTRIAL APPLICABILITY

At least one embodiment of the present invention may be preferably used as a variable-geometry exhaust turbocharger used in an engine, preferably in a gasoline engine for a vehicle.

REFERENCE SIGNS LIST

1 Variable-geometry exhaust turbocharger
2 Nozzle mount
3 Lever plate
4 Nozzle plate
5 Drive ring
6 Nozzle support
8 Nozzle vane
8*a* Nozzle shaft
10 Variable nozzle mechanism
12 Turbine rotor
12*a* Rotational shaft
16 Turbine housing
18 Bearing housing
20 Exhaust gas channel
22 Bearing
24 Exhaust-gas outlet

The invention claimed is:

1. A variable-geometry exhaust turbocharger, comprising:

a nozzle mount fixed to a housing, the nozzle mount having a first face and a second face;

a nozzle support having a first end coupled to the first face of the nozzle mount, the nozzle support being a cylindrical member;

a nozzle plate coupled to a second end of the nozzle support and supported to be separated from the first face of the nozzle mount, the nozzle plate having a first face coupled to the nozzle support and a second face which is opposite to the first face;

a plurality of nozzle vanes rotatably supported between the first face of the nozzle mount and the first face of the nozzle plate; and a variable nozzle mechanism configured to change vane angles of the nozzle vanes to control a flow of an exhaust gas flowing between the first face of the nozzle mount and the first face of the nozzle plate, wherein the nozzle support is capable of tilting along a radial direction due to a difference in an amount of thermal deformation between the nozzle mount and the nozzle plate, wherein the nozzle mount is exposed to the exhaust gas only at the first face, and wherein the nozzle plate is exposed to the exhaust gas at both the first face and the second face and is formed of a material having a smaller linear expansion coefficient than that of a material forming the nozzle mount.

2. The variable-geometry exhaust turbocharger according to claim 1, wherein the nozzle plate is formed of heat-resistant Ni-base alloy, and wherein the nozzle mount is formed of stainless steel.

3. The variable-geometry exhaust turbocharger according to claim 1, wherein the nozzle plate and the nozzle mount are formed of different kinds of heat-resistant Ni-base alloy having different linear expansion coefficients.

4. The variable-geometry exhaust turbocharger according to claim 1, wherein the materials forming the nozzle plate and the nozzle mount are each selected so that an absolute value of an extension rate difference A defined by the following equation (1) is not greater than 0.20%:

$$A=\{\alpha 1\times(T1-T)-\alpha 2(T2-T)\}\times 100 \qquad \text{Equation (1),}$$

where:

$\alpha 1$ is a linear expansion coefficient of the material forming the nozzle plate;

$\alpha 2$ is a linear expansion coefficient of the material forming the nozzle mount;

T1 is a temperature of the nozzle plate during operation of an engine;

T2 is a temperature of the nozzle mount during operation of the engine; and

T is a reference temperature.

5. The variable-geometry exhaust turbocharger according to claim 1, wherein the variable-geometry exhaust turbocharger is used in a gasoline engine.

* * * * *